US008453796B2

(12) United States Patent
Astor et al.

(10) Patent No.: US 8,453,796 B2
(45) Date of Patent: Jun. 4, 2013

(54) TRADE BASED COMPONENT CASE AND LADDER BUCKET

(75) Inventors: Kyle G. Astor, Meadville, PA (US); Robert J. Glenn, II, Chicago, IL (US)

(73) Assignee: Werner Co., Greenville, PA (US)

( * ) Notice: Subject to any disclaimer, the term of this patent is extended or adjusted under 35 U.S.C. 154(b) by 585 days.

(21) Appl. No.: 11/449,457

(22) Filed: Jun. 7, 2006

(65) Prior Publication Data

US 2007/0284191 A1 Dec. 13, 2007

(51) Int. Cl.
*E04G 5/00* (2006.01)

(52) U.S. Cl.
USPC ..... 182/129; 182/119; 182/230; 206/372; 206/373

(58) Field of Classification Search
USPC ... 182/119, 129, 230; 206/372, 373; 248/210, 248/211, 238; 211/71.01, 87.01, 88.01, 126.4
See application file for complete search history.

(56) References Cited

U.S. PATENT DOCUMENTS

| | | | | | |
|---|---|---|---|---|---|
| 1,794,700 | A * | 3/1931 | McCaskey | 248/224.51 |
| 3,477,679 | A * | 11/1969 | Lovitz | 248/213.2 |
| 3,915,189 | A * | 10/1975 | Holbrook et al. | 137/205 |
| 4,176,580 | A * | 12/1979 | Gallegos | 84/327 |
| 4,653,713 | A * | 3/1987 | Hamilton | 248/238 |
| 4,858,869 | A * | 8/1989 | Stang | 248/311.2 |
| 5,035,389 | A * | 7/1991 | Wang | 248/224.51 |
| 5,240,214 | A * | 8/1993 | Birnbaum et al. | 248/231.41 |
| 5,259,480 | A * | 11/1993 | Bartnicki et al. | 182/173 |
| 5,358,070 | A * | 10/1994 | Bartnicki et al. | 182/173 |
| 5,370,263 | A * | 12/1994 | Brown | 220/751 |
| 5,433,416 | A * | 7/1995 | Johnson | 248/475.1 |
| 5,503,245 | A * | 4/1996 | Etesam | 182/129 |
| 5,547,080 | A * | 8/1996 | Klimas | 206/373 |
| 5,573,081 | A * | 11/1996 | Bartnicki et al. | 182/129 |
| 5,584,357 | A * | 12/1996 | Gugel et al. | 182/129 |
| 5,622,278 | A * | 4/1997 | Fries et al. | 220/480 |
| 5,740,883 | A * | 4/1998 | Trank | 182/129 |
| 5,782,314 | A * | 7/1998 | Zeitler | 182/129 |
| 5,899,420 | A * | 5/1999 | Gerardi | 248/146 |
| 5,924,615 | A * | 7/1999 | McGarrah | 224/404 |
| 6,401,862 | B1 * | 6/2002 | Caron | 182/129 |
| 6,412,601 | B1 * | 7/2002 | Schmidt | 182/129 |
| 6,443,260 | B1 * | 9/2002 | Katz et al. | 182/129 |
| 6,467,577 | B1 * | 10/2002 | Charlebois, Jr. | 182/129 |
| 6,827,215 | B1 * | 12/2004 | Lane | 206/525 |
| 6,837,383 | B1 * | 1/2005 | McElhaney, Jr. | 211/70.6 |
| 7,032,711 | B1 * | 4/2006 | Katz et al. | 182/129 |
| 7,270,307 | B2 * | 9/2007 | Zodnik | 248/238 |
| 2002/0017430 | A1 * | 2/2002 | Rosko | 182/129 |
| 2005/0258002 | A1 * | 11/2005 | Sabo | 182/129 |
| 2007/0181367 | A1 * | 8/2007 | Astor | 182/129 |
| 2009/0078504 | A1 * | 3/2009 | Astor | 182/129 |
| 2009/0179125 | A1 * | 7/2009 | Astor et al. | 248/238 |

* cited by examiner

*Primary Examiner* — Katherine Mitchell
*Assistant Examiner* — Colleen M Chavchavadze
(74) *Attorney, Agent, or Firm* — Ansel M. Schwartz

(57) ABSTRACT

A ladder system includes a ladder having a ladder top, the ladder top having at least a first slot. A container having at least a first protrusion that engages with the first slot to hold the container to the top. A method for working from a ladder. The method includes the steps of filling a container with objects and engaging a first protrusion of the container with a first slot of a top of the ladder to hold a container to the top.

16 Claims, 8 Drawing Sheets

TRADE BASED COMPONENT CASE AND LADDER BUCKET

FIELD OF THE INVENTION

The present invention is related to a ladder having a container that attaches to a top of the ladder. More specifically, the present invention is related to a ladder having a component case or a ladder bucket that attaches to a top of the ladder.

BACKGROUND OF THE INVENTION

Professionals use containers for their tools and small parts. The problem they have is for the tools and small parts in the container to be readily available to them when they are working while on a ladder.

BRIEF SUMMARY OF THE INVENTION

The present invention pertains to a ladder system. The system comprises a ladder having a ladder top. The ladder top has at least a first slot. The system has a container having at least a first protrusion that engages with the first slot to hold the container to the top.

The present invention pertains to a method for working from a ladder. The method comprises the steps of filling a container with objects. There is the step of engaging a first protrusion of the container with a first slot of a top of the ladder to hold the container to the top.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
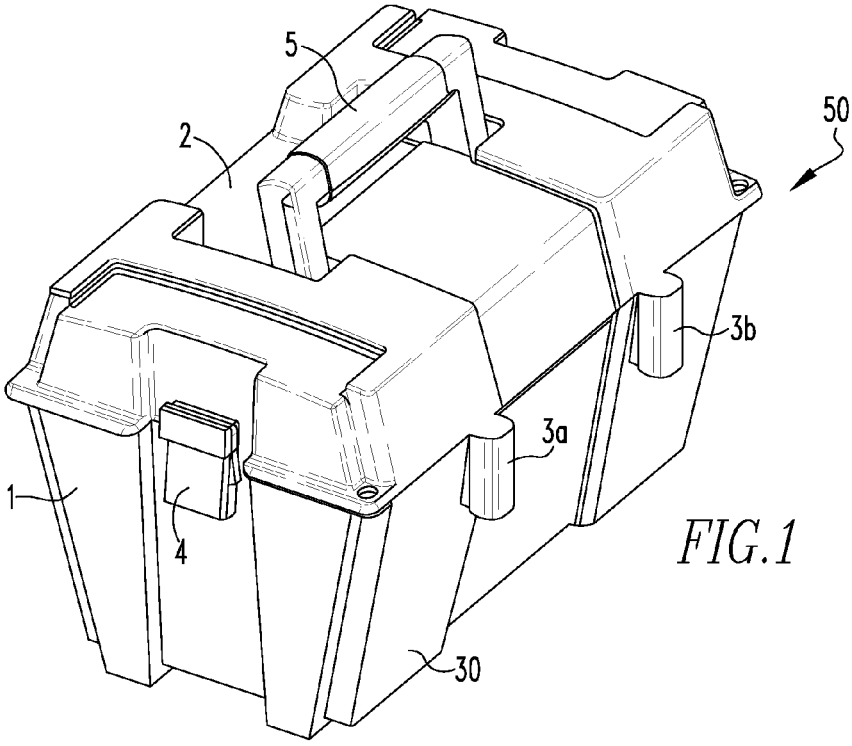
FIG. 1 is a schematic representation of the case of the present invention.

Referring now to the drawings wherein like reference numerals refer to similar or identical parts throughout the several views, and more specifically to FIGS. 3, 5, 9 and 10 thereof, there is shown a ladder system 100. The system 100 comprises a ladder 25 having a ladder top 11. The ladder top 11 has at least a first slot 8*a*, the first slot 8*a* being a tool slot when the first protrusion is not disposed in the first slot 8*a*. The system 100 has a container 75 having at least a first protrusion 3*a* that engages with the first slot 8*a* to hold the container 75 to the top 11.

Preferably, the container 75 has a handle 5. The top 11 preferably has a second slot 8*b*, and the container 75 has a second protrusion 3*b* which fits in the second slot 8*b*. Preferably, each slot has a diameter which is smaller at its bottom than at its top, and each protrusion has a diameter which is smaller at its bottom than at its top. Each slot is preferably disposed at an edge of the top. Preferably, each protrusion is disposed at a first side 30 of the container 75. The container 75 preferably has a second side 32 in parallel with the first side 30, a third side 34 connected with the first and second sides 30, 32 and a fourth side 36 in parallel with the third side 34 and connected with the first and second sides 30, 32.

Preferably, the sides form a rectangular shape. The ladder 25 is preferably a stepladder. The container 75 can be a case 50. The case 50 preferably has a lower section 1 and an upper section 2. Preferably, the upper section 2 is pivotally connected to the lower section 1. The handle 5 is preferably connected to the upper section 2. Preferably, on the third side 34 is a first clasp 4*a*, and on the fourth side 36 is a second clasp 4*b* which lock the first and second portions together. The container 75 can be a bucket 9. Preferably, the handle 10 extends from the third side 34 and the fourth side 36.

The present invention pertains to a method for working from a ladder 25. The method comprises the steps of filling a container 75 with objects. There is the step of engaging a first protrusion 3*a* of the container 75 with a first slot 8*a* of a top 11 of the ladder 25 to hold the container 75 to the top.

Preferably, the engaging step includes the step of engaging a second protrusion 3*b* of the container 75 with a second slot 8*b* of the top 11 of the ladder 25 to hold the container 75 to the top 11. There is preferably the step of carrying the container 75 by its handle 5 up the ladder 25. Preferably, the container 75 is a case 50, and there is the step of opening an upper portion 2 of the case 50 to access the objects in a lower portion 1 of the case 50.

The new component case 50 and ladder bucket 9 of the present invention allow the user a place to store all of these items while providing a secure storage at the top of the ladder 25. The component case 50 and ladder bucket 9 can be filled with all of the tools and materials necessary and then quickly and easily fastened high up on the ladder 25. This makes multiple trips up and down the ladder 25 unnecessary.

Figure 2:
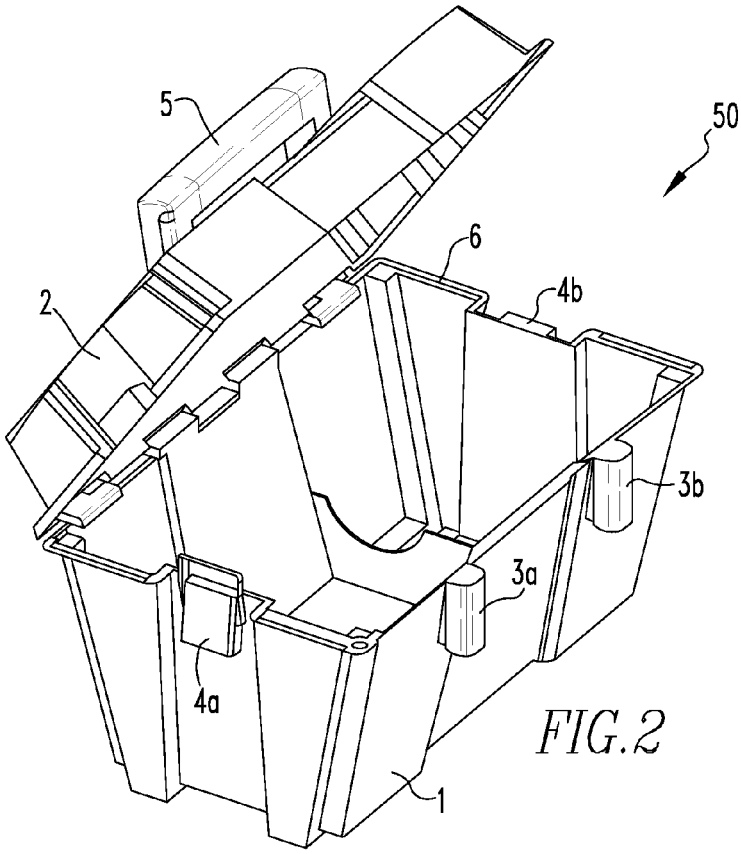
FIG. 2 is a schematic representation of the case.
Figure 3:
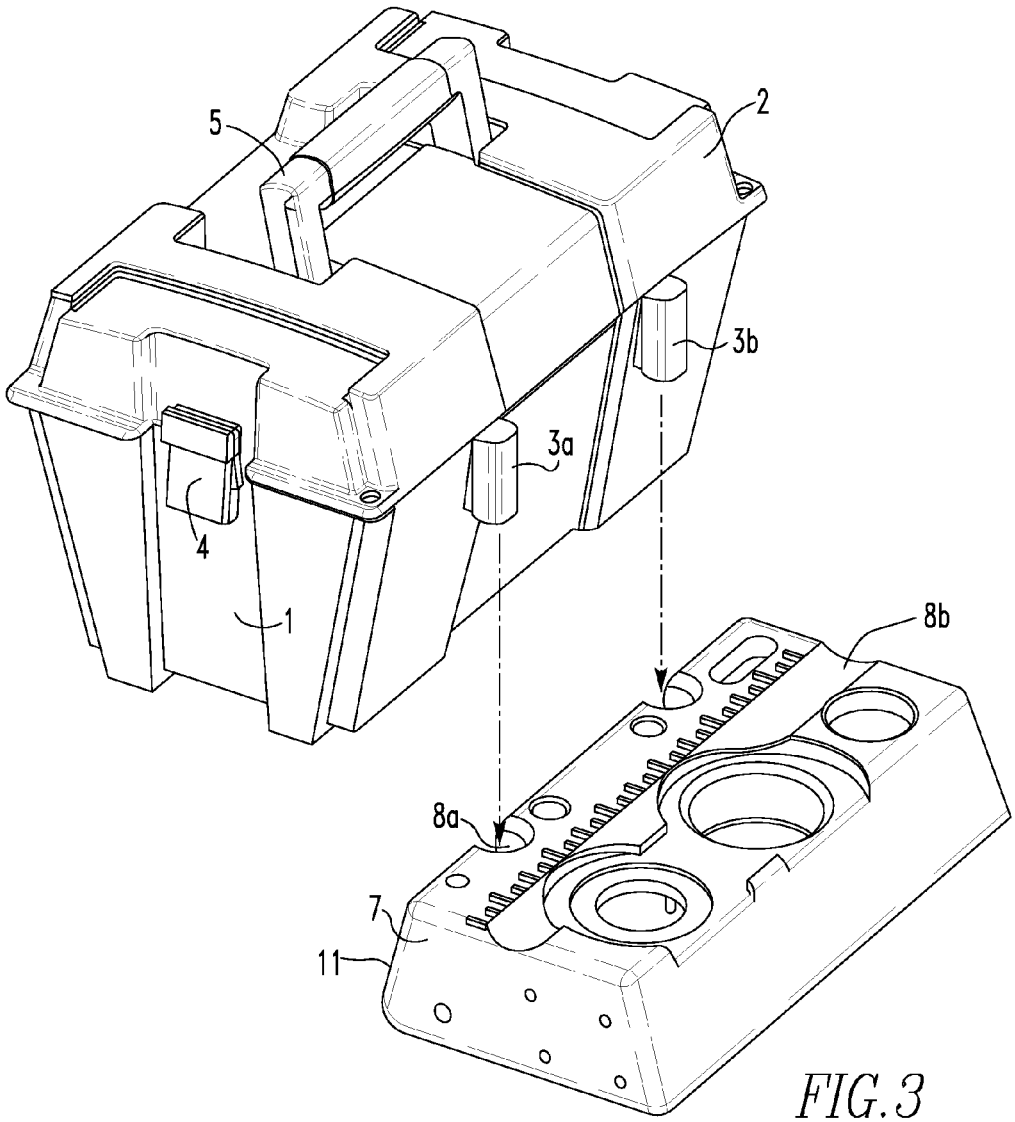
FIG. 3 is a schematic representation of the case and a ladder top.

The component case 50, as shown in FIG. 1, consists of a lower section 1 and an upper section 2. The two sections 1, 2 are connected at the pivot point, as shown in FIG. 2. Attached to the middle of the upper lid section 2 is a handle 5. On each side of the case 50 are clasps 4*a*, 4*b* that lock the two portions together.

Figure 4:
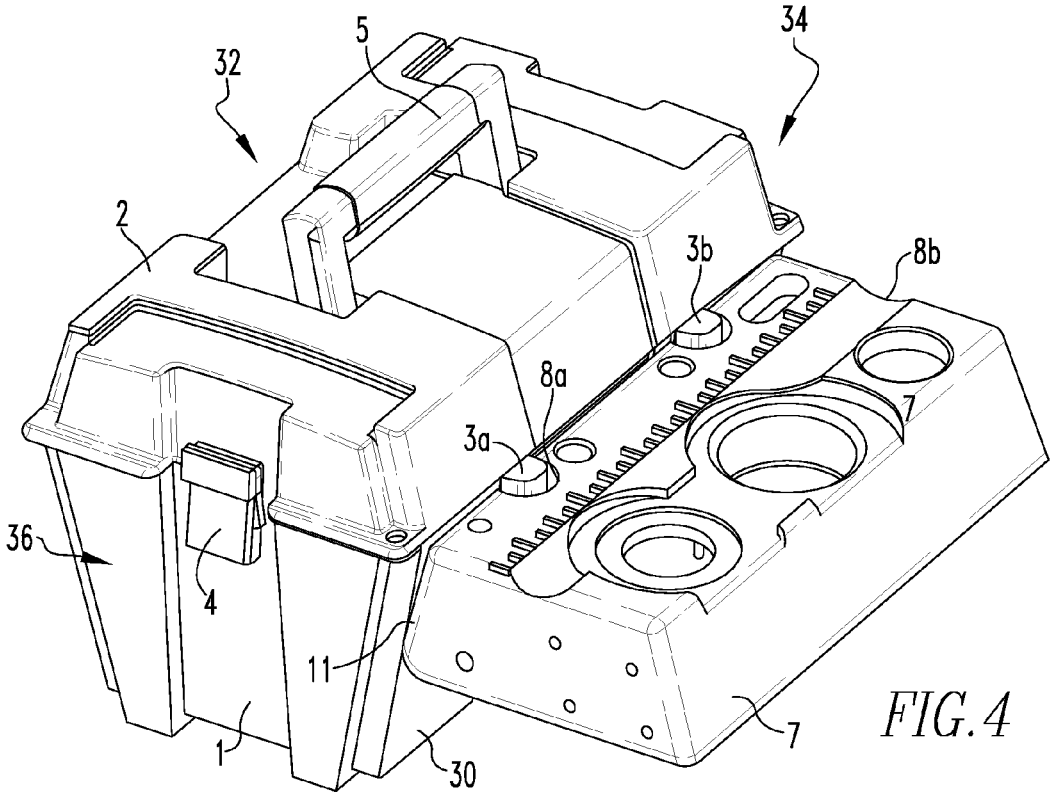
FIG. 4 is a schematic representation of the case and the ladder top.

The two protrusions 3*a* and 3*b* side into ladder top slots 7, as shown in FIG. 4. The protrusions 3*a*, 3*b* fit into the corresponding slots 8*a*, 8*b* on the top. The slots 8*a*, 8*b* on the top are in the previous Electrician's and Pipe Trade Stepladder patent applications having U.S. patent application Ser. Nos. 11/358,626 and 11/416,967, respectively, incorporated by reference herein. The protrusions 3*a*, 3*b* firmly wedge into the slots 8 on the top. The weight of the case 50 is then supported by the protrusions 3 in the slots 8 and by resting on the front of the ladder top 11.

Figure 5:
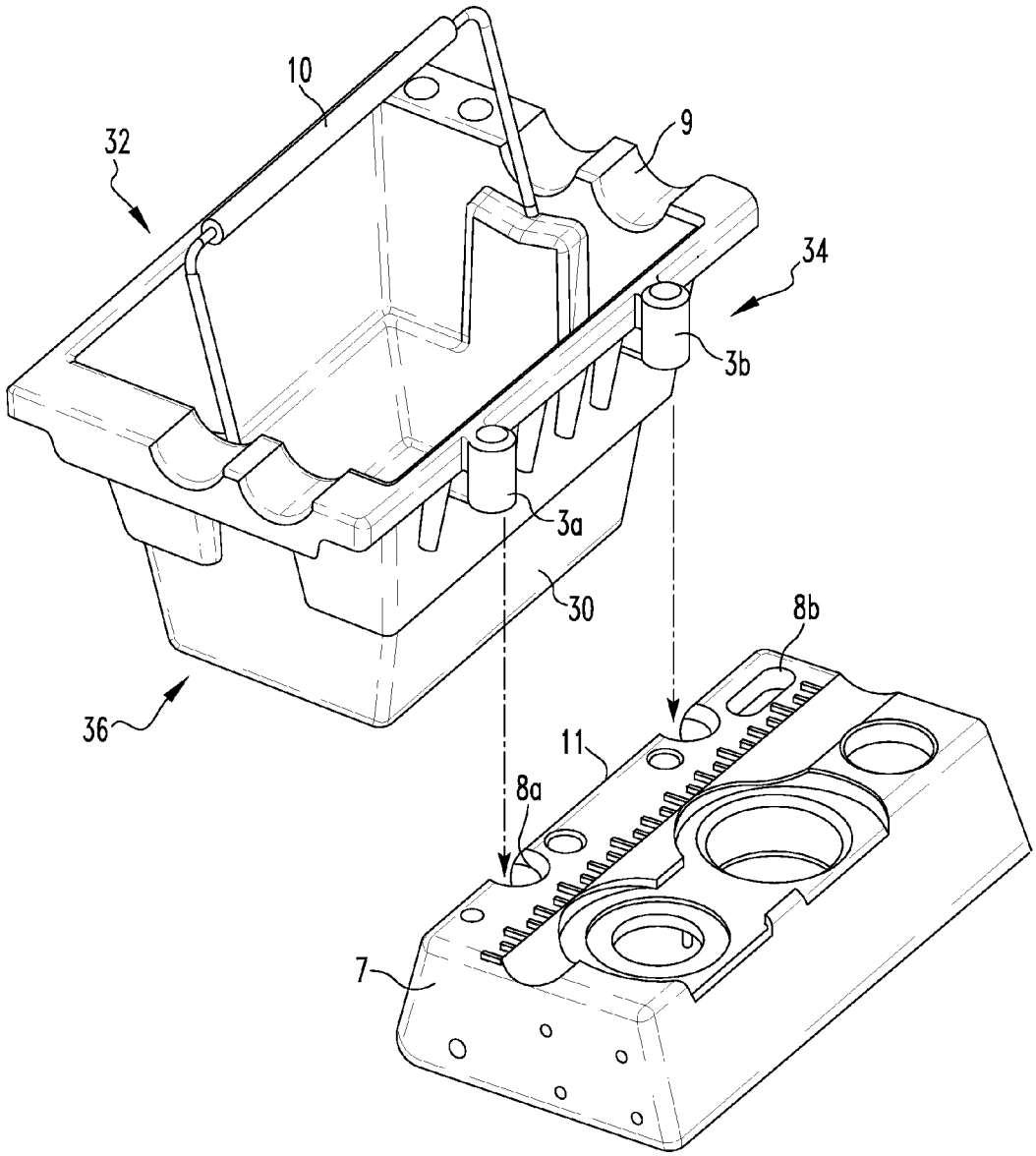
FIG. 5 is a schematic representation of the bucket of the present invention.
Figure 6:
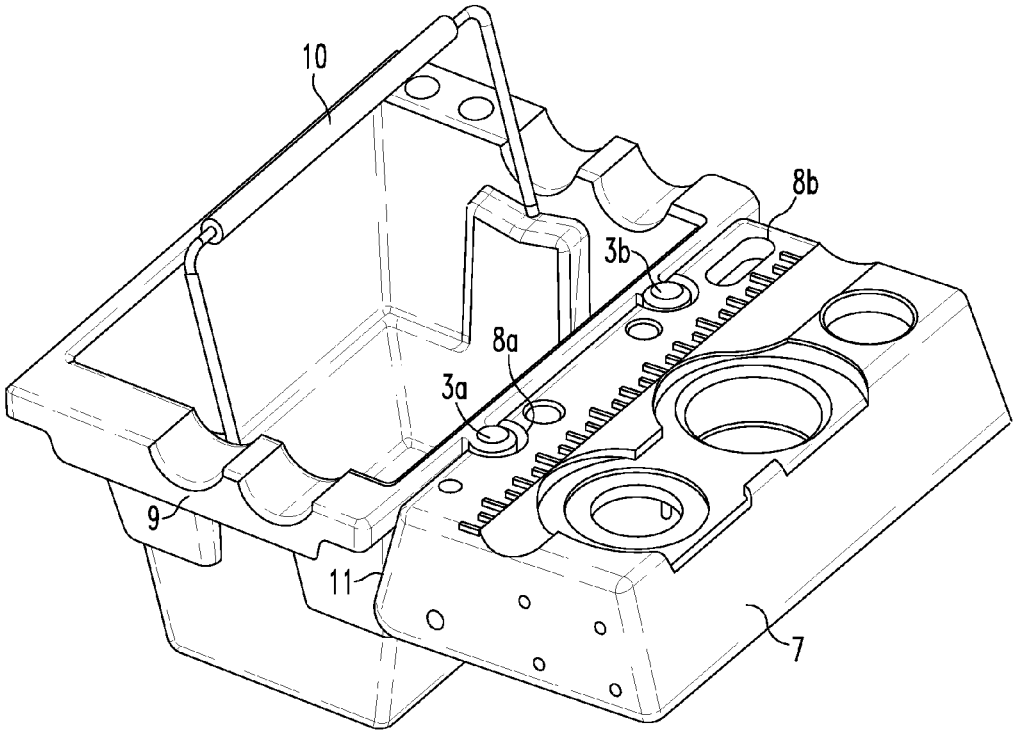
FIG. 6 is a schematic representation of the bucket.
Figure 7:
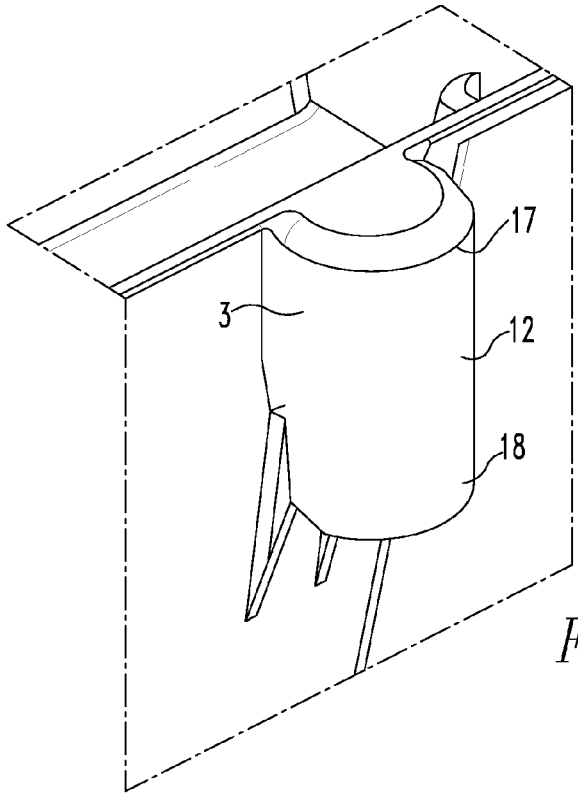
FIG. 7 is a schematic representation of a protrusion of the case or bucket.
Figure 8:
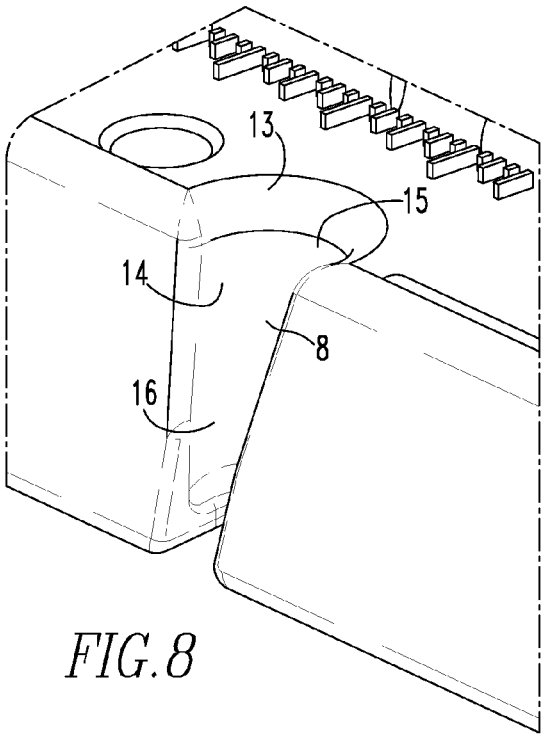
FIG. 8 is a schematic representation of a slot of the top which receives the protrusion.
Figure 9:
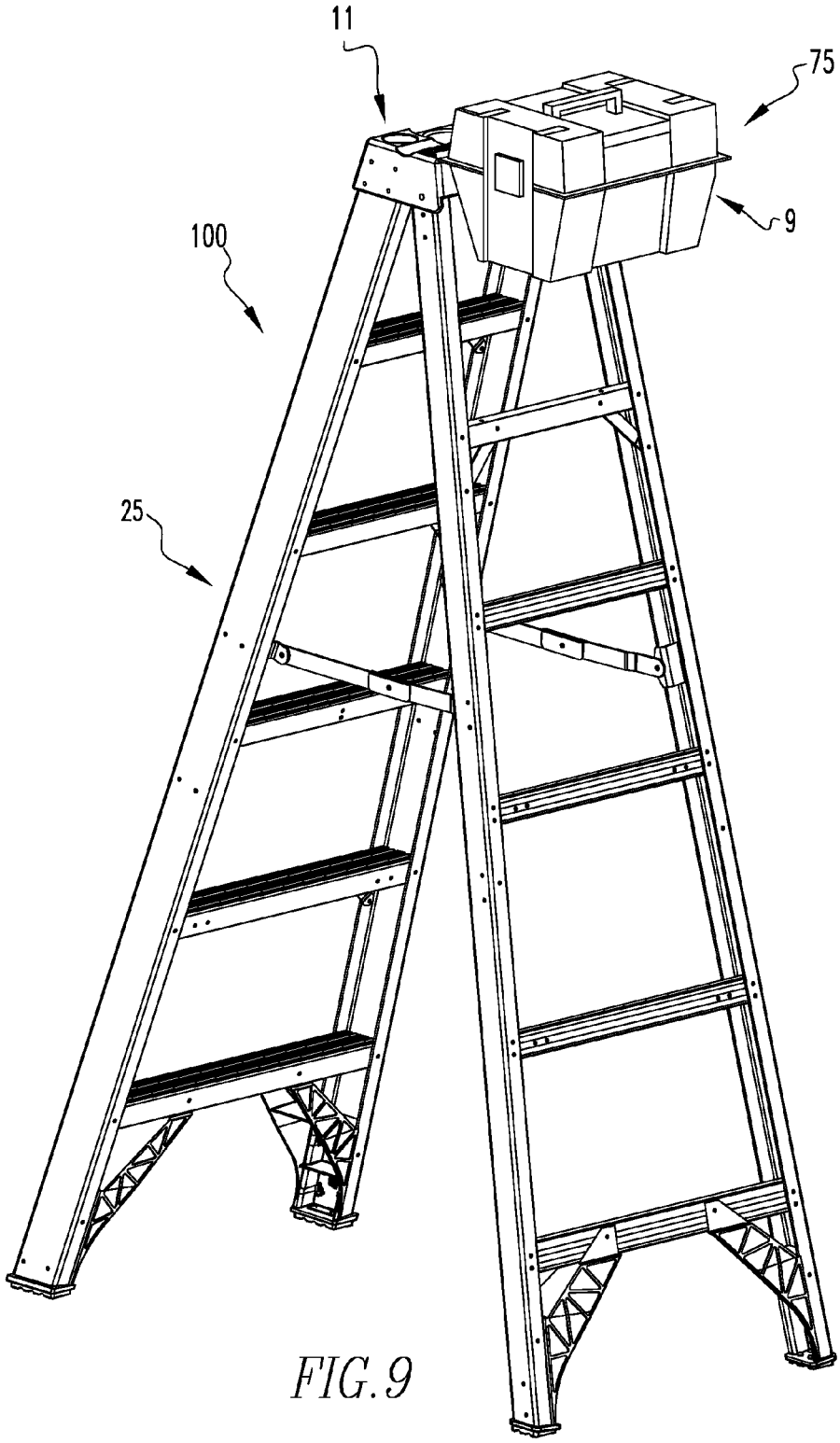
FIG. 9 is a schematic representation of a ladder with a case.
Figure 10:
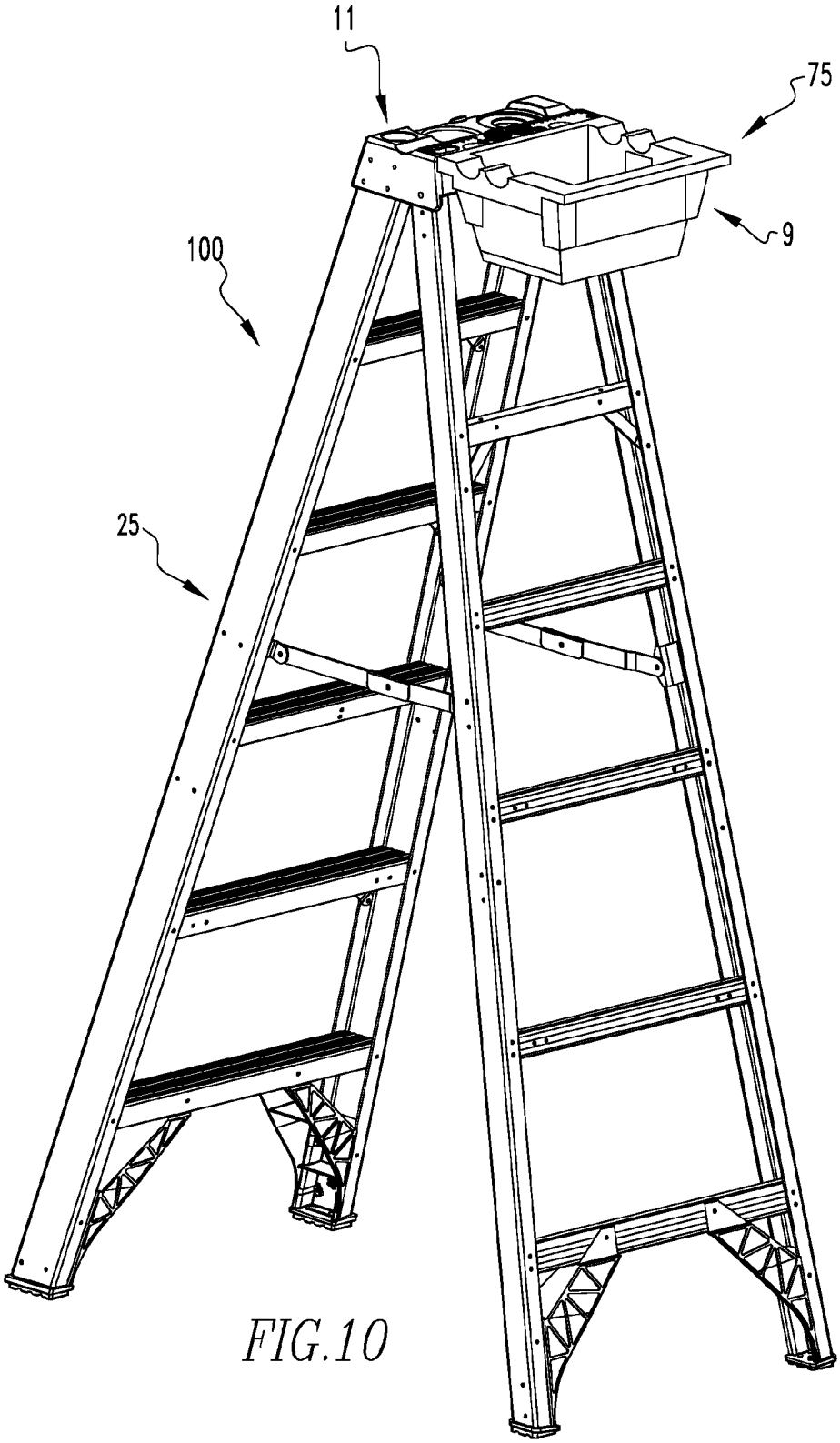
FIG. 10 is a schematic representation of a ladder with a bucket.

The ladder bucket 9, as shown in FIG. 5, is a plastic bucket shaped container with protrusions similar to those on the component case 50. The plastic bucket 9 has a handle 10 that can be used to carry the bucket 9 to the top of the ladder 25 where it will be attached.

The two protrusions 3*a* and 3*b* slide into ladder top 11, as shown in FIG. 4. The protrusions fit into the corresponding slots on the top 8*a*, 8*b*. The protrusions 3*a*, 3*b* firmly wedge into the slots 8 on the top. The weight of the bucket 9 is then supported by the protrusions 3 in the slots 8 and by resting on the front of the ladder top 11.

The male protrusion 3 is shaped to fit the female geometry 8. The protrusion 3 has a tapered shape 12. The feature is larger at the top 17 and gets smaller near the bottom 18. The female feature 8 is designed with a taper 14 that will fit the male feature 3. The female feature is larger at the top 15 and gets smaller at the bottom 16. The feature 8 also is designed with a lead in 13 to guide the male protrusion 3 into the slot 8.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A ladder system comprising:

a step ladder having a front section and a rear section having at least one step and having a ladder top, the ladder top having periphery and a front with a front facing edge and a rear in spaced relation to the front and essentially in parallel with the front, the front essentially in parallel and disposed over the front section, the rear essentially in parallel and disposed over the rear section, the ladder top having at least a first slot having an opening in the periphery disposed on the front facing edge, the first slot has a lead in at the first slot's top, the slot has a diameter which is smaller at its bottom than at its top, the first slot is disposed at an edge of the top; and a container having at least a first protrusion that engages with the first slot to hold the container to the top, the protrusion has a diameter which is smaller at its bottom than its top, the container has a handle, the lead in guides the first protrusion into the first slot, the weight of the container supported by the first protrusion in the first slot and by resting on the front of the top, the first protrusion's shape corresponds with the first slot's shape to fit with the first slot, the first slot being a tool slot when the first protrusion is not disposed in the first slot.

2. A system as described in claim 1 wherein the top has a second slot having an opening in the periphery disposed at the front edge, and the container has a second protrusion which fits in the second slot.

3. A system as described in claim 2 wherein the second slot has a diameter which is smaller at its bottom than at its top, and each protrusion has a diameter which is smaller at its bottom than at its top, the second slot has a lead in at the second slot's top which guides the second protrusion into the second slot.

4. A system as described in claim 3 wherein each protrusion is disposed at a first side of the container.

5. A system as described in claim 4 wherein the container has a second side in parallel with the first side, a third side connected with the first and second sides and a fourth side in parallel with the third side and connected with the first and second sides.

6. A system as described in claim 5 wherein the sides form a rectangular shape.

7. A system as described in claim 6 wherein the container is a case.

8. A system as described in claim 7 wherein the case has a lower section and an upper section.

9. A system as described in claim 8 wherein the upper section is pivotally connected to the lower section.

10. A system as described in claim 9 wherein the handle is connected to the upper section.

11. A system as described in claim 10 wherein on the third side is a first clasp, and on the fourth side is a second clasp which lock the first and second portions together.

12. A system as described in claim 6 wherein the container is a bucket.

13. A system as described in claim 12 wherein the handle extends from the third side and the fourth side.

14. A system as described in claim 13 wherein the third side and fourth side each have a first circular indentation in alignment with each other.

15. A system as described in claim 14 wherein the third side and fourth side each have a second circular indentation in alignment with each other and alongside the respective first circular indentation.

16. A system as described in claim 15 wherein the first protrusion has an essentially cylindrical or conical shape.

* * * * *